United States Patent [19]

Mizunuma

[11] Patent Number: 4,993,336

[45] Date of Patent: Feb. 19, 1991

[54] NEEDLE LOCKER IN AN OVERLOCK SEWING MACHINE

[75] Inventor: Masanori Mizunuma, Tochigi, Japan

[73] Assignee: SSMC Inc., Edison, N.J.

[21] Appl. No.: 364,295

[22] Filed: Jun. 12, 1989

[30] Foreign Application Priority Data

Jul. 15, 1988 [JP] Japan ..... 63-93835[U]

[51] Int. Cl.[5] ..... D05B 55/02

[52] U.S. Cl. ..... 112/226; 112/80.45

[58] Field of Search ..... 112/80.45, 222, 226

[56] References Cited

U.S. PATENT DOCUMENTS

| | | | |
|---|---|---|---|
| 1,309,272 | 7/1919 | Berger | 112/226 |
| 1,515,301 | 11/1924 | Fink | 112/226 X |
| 3,020,866 | 2/1962 | Fujita | 112/226 |
| 3,348,508 | 10/1967 | Eguchi et al. | 112/226 |
| 4,111,139 | 9/1978 | Klundt | 112/226 |

*Primary Examiner*—Werner H. Schroeder
*Assistant Examiner*—Paul C. Lewis
*Attorney, Agent, or Firm*—Theodore Jay

[57] ABSTRACT

A needle locker has a body having therein a first needle receiving hole and a second needle receiving hole. The first needle receiving hole is arranged in a direction perpendicular to the cloth feeding direction. The second needle receiving hole is adjacent the first needle receiving hole and arranged in the same direction. Two needles are disposed in the first needle receiving hole in adjacent parallel relationship and are detachably secured in the first needle receiving hole by a first setscrew. A single needle is inserted in and fitted detachably to the second needle receiving hole by a second short needle setscrew.

4 Claims, 2 Drawing Sheets

NEEDLE LOCKER IN AN OVERLOCK SEWING MACHINE

BACKGROUND OF THE INVENTION

1. Field of the Invention:

The present invention relates to a needle locker in an overlock sewing machine for stitching hems of the cloth to prevent fraying of the hems of the cloth.

2. Description of the Prior Art:

In prior art overlock sewing machines, it is known that the hemstitching operation using a machine employing two needles with four threads can be switched to a machine using two needles with five threads. The overlock sewing machine for carrying out the hemstitching operation using two needles with four threads carries out the hemstitch of Stitching type #514 while the overlock sewing machine for carrying out the hemstitching operation using two needles with five threads carries out the hemstitch of Stitching type #516. The needle locker for carrying out the hemstitch using two needles with four threads employs two needles arranged in parallel across the cloth feeding direction while the needle locker for carrying out the hemstitch using two needles with five threads employs two needles arranged in the feeding direction and across the feeding direction in a predetermined interval.

However, the prior art overlock sewing machine exhibits a problem: at the time when the hemstitch operation using two needles and four threads is shifted to the hemstitch operation using two needles and five threads, a separate needle locker must be substituted despite the fact that one needle is mounted in the same position in a needle locker as the other needle. As a result, two needle lockers are required and additional time is required for substituting one locker for another.

SUMMARY OF THE INVENTION

It is therefore an object of the present invention to provide a needle locker in an overlock sewing machine capable of shifting the hemstitch operation by two needles with four threads to the hemstitch operation by two needles with five threads or vice versa with ease and simple structure.

To achieve the above object, the needle locker in an overlock sewing machine comprises a body; a recess defined at the upper portion of the body for receiving a needle bar, the needle bar being fitted detachably thereto by a setscrew; and a first elliptically shaped needle receiving hole defined at the lower portion of the body and disposed substantially just under the needle bar. The first needle receiving hole has an opening below the recess and extends in parallel with the axis of the first needle bar and in the direction perpendicular to the cloth feeding direction. A second needle receiving hole is disposed in the lower portion of the body and is positioned adjacent the first needle receiving hole at the rear side of the cloth feeding direction, being in eccentric relation with the direction perpendicular to the cloth feeding direction and extending in parallel with the axis of the needle bar. Two needles are receiving in the first needle receiving hole in adjacent parallel relation and are detachably secured to the first needle receiving hole by a first long needle setscrew. The tip end of the setscrew is inserted between the two needles and presses and contracts both needles. A single needle is inserted in and fitted detachably to the second needle receiving hole by a second short needle setscrew. A flat tip end surface of the second setscrew presses and contacts the single needle.

The above and other objects, features and advantages of the present invention will become more apparent from the following description taken in conjunction with the accompanying drawings.

DESCRIPTION OF THE PREFERRED EMBODIMENT

Figure 1:
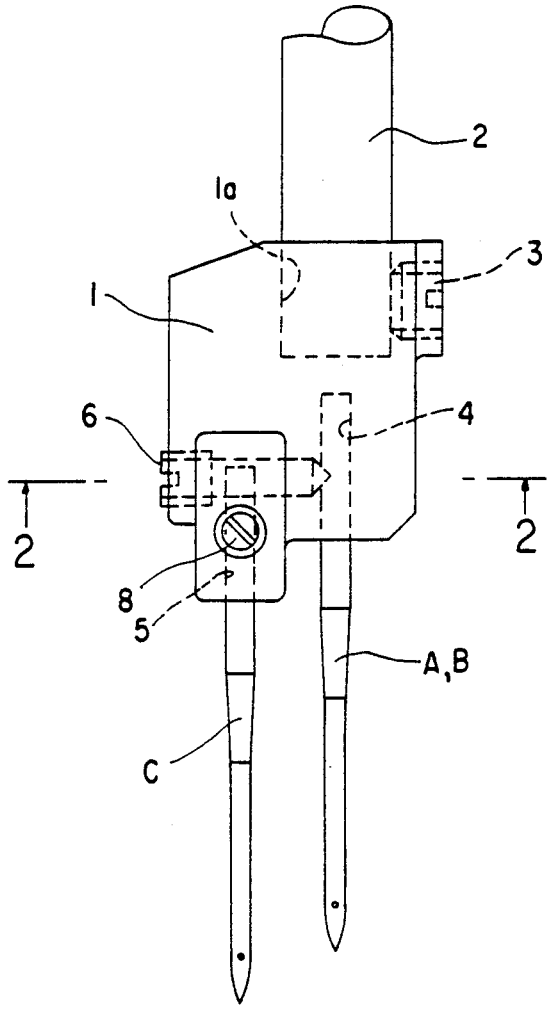
FIG. 1 is a side view of a needle locker containing two needles in accordance with a preferred embodiment of the invention.

A needle locker for an overlock sewing machine according to a preferred embodiment of the present invention is shown in FIGS. 1-4.

A needle locker comprises a body 1 having a recess 1*a* at the upper portion thereof. A needle bar 2 supported vertically movably by an arm of the sewing machine is fitted detachably to the recess 1*a* by a setscrew 3 screwed into the recess 1*a* from the upper surface of the body. A first needle receiving hole or bore 4 having a uniform cross section defining an ellipse is positioned substantially just under the needle bar 2. The needle receiving hole 4 is open in a position adjacent the recess 1*a* and extends in parallel with the axis of the needle bar 2 and in a direction perpendicular to the cloth feeding direction of the material 9 to be sewn. A second needle hole or bore 5 in body 7 is positioned at the rear side of the cloth feeding direction and is offset from and in parallel with the axis of the needle bar 2. Two needles A, B are disposed the needles receiving hole 4 in adjacent parallel relation and are detachably secured in the needle receiving hole 4 by a first long needle setscrew 6. The tip end of the setscrew 6 is inserted between two needles and presses and contacts the needles A, B. A needle C is disposed detachably in the second needle receiving hole 5 by a second short needle setscrew 8. A flat tip end surface of the second setscrew 8 presses and contacts the single needle C.

An operation of the needle locker will be described hereinafter.

Figure 3:
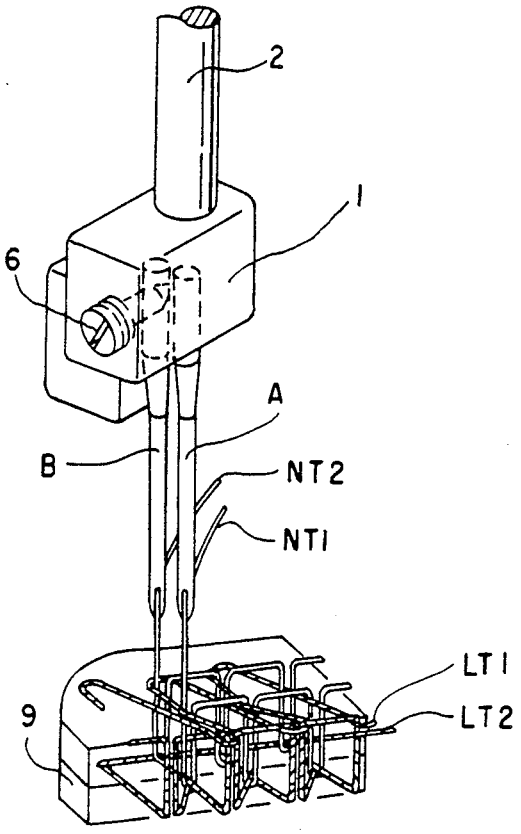
FIGS. 3 and 4 are perspective views illustrating different operations of the needle locker.

When a hemstitch operation using two needles with four threads is carried out, the needle C is removed from the second needle receiving hole 5 while the two needles A, B are fitted in the first needle receiving hole 4 in parallel relation thereto. At this point, the conical shaped tip end 7 of the setscrew 6 presses and contacts the two needles A, B which are individually pressed into the inner wall of the first needle receiving hole 4. This stitch is defined by needle threads NT1, NT2 and looper threads LT1, LT2 which are entangled with each other as shown in FIG. 3.

Figure 4:
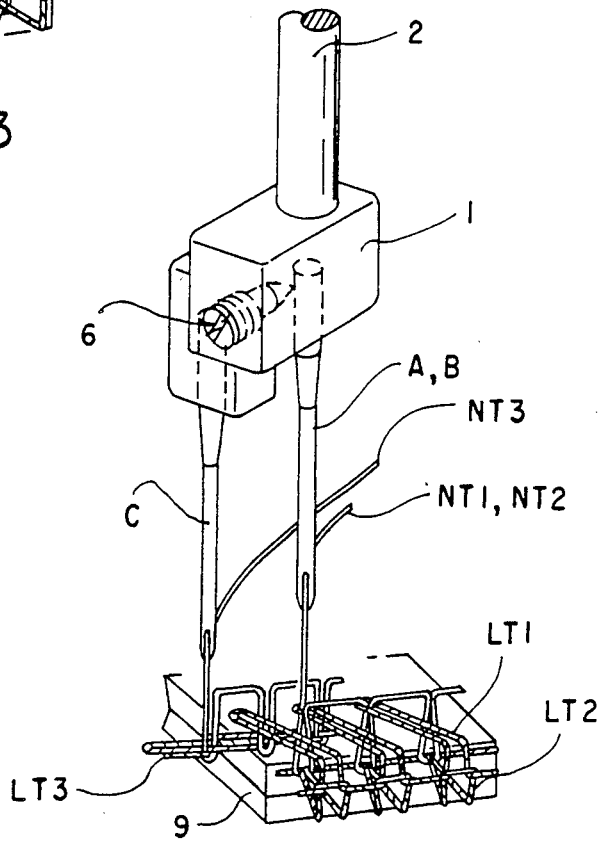

When this hemstitch operation is changed to the hemstitch operation of using two needles and five threads as shown in FIG. 4, one of the needles A and B is removed from the first needle receiving hole 4 by operating the first setscrew 6 while the needle C is secured to the second needle receiving hole 5 by the second needle setscrew 8. At this conical tip end 7 of the first needle setscrew 6 presses and contacts the side of one of the needles A and B which is attached to the needle locker 1. The #516 stitch is defined by one of the threads NT1 and NT2, a thread NT3 threaded into the needle C, and looper threads LT1, LT2, LT3 respectively threaded into the three loopers (not shown) of the overlock sewing machine, which are entangled with each other.

Figure 2:
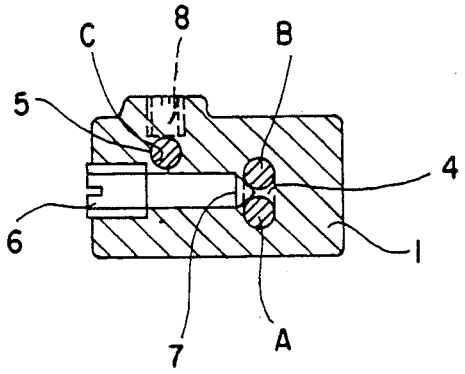
FIG. 2 is a cross sectional view taken along II—II of FIG. 1.

According to the present preferred embodiment, although the first needle setscrew 6 in FIG. 2 is constructed to be inserted from the left side without crossing the second needle receiving hole 5, it can be inserted from the right side to obtain the same effect. When where the first needle setscrew is inserted from the right side, the second needle setscrew 8 can be inserted from the upper portion or the lower portion thereof to obtain the same effect.

With the arrangement of the needle locker according to the present invention, the hemstitch operation using two needles with four threads can be easily changed to the hemstitch operation using two needles with five threads or vice versa by changing the secured position of the one needle by operating the first needle setscrew and the second needle setscrew. Accordingly, the changing operation is remarkably effective and structure is very simple since the changing operation can be made in the body of the needle locker whereby the needle locker in the overlock sewing machine is provided at low cost.

Although the invention has been described in its preferred form with a certain degree of particularity, it is to be understood that many variations and changes are possible in the invention without departing from the scope thereof.

What is claimed is:

1. A needle locker for an overlock sewing machine having a given direction of material feed, said locker comprising;

a vertical locker body having a vertical recess extending downwardly therein from an upper end of the body, said recess extending perpendicular to said direction of feed;

a first vertical bore disposed in said body and aligned with said recess, the bore having an upper end disposed adjacent but below said recess and a lower open end, said first bore having a cross section in the shape of an ellipse;

a second vertical bore disposed in said body and offset from but parallel to the first bore, first, second, and third vertical needles, the first and second needles being disposed removably in parallel adjacent relationship in said first bore and having downwardly pointed lower the extending below said body, the third needle being disposed removably in said second bore and having a downwardly pointed lower end extending below said body;

first manually operated means for detachably securing said first needles in said first and second bore; and second manually operated means for detachably securing said third needle in said second bore.

2. The locker of claim 1 wherein said body has a front side and a rear side with respect to the direction of material feed, the second bore being disposed adjacent said rear side.

3. The locker of claim 2 further including a vertical needle bar disposed detachably in said recess and third means for securing said bar detachably in the recess.

4. The locker of claim 3 wherein each of said first, second and third means is a manually operated screw.

* * * * *